United States Patent [19]

Trötscher

[11] Patent Number: 4,467,537

[45] Date of Patent: Aug. 28, 1984

[54] EQUIPMENT FOR HEAT-TREATING FLAT, BAND-LIKE LENGTHS OF MATERIAL

[75] Inventor: Gerhard Trötscher, Lindau, Fed. Rep. of Germany

[73] Assignee: Lindauer Dornier Gesellschaft mbH., Fed. Rep. of Germany

[21] Appl. No.: 180,582

[22] Filed: Aug. 25, 1980

[30] Foreign Application Priority Data

Sep. 1, 1979 [DE] Fed. Rep. of Germany ..... 2935373

[51] Int. Cl.[3] ..... F26B 13/02

[52] U.S. Cl. ..... 34/155; 34/160

[58] Field of Search ..... 226/97; 34/155, 156, 34/225, 233, 160

[56] References Cited

U.S. PATENT DOCUMENTS

| | | | |
|---|---|---|---|
| 2,700,226 | 1/1955 | Dungler | 34/160 |
| 3,324,570 | 6/1967 | Flaith et al. | 34/156 |
| 3,800,438 | 4/1974 | Windhorst | 34/156 |
| 4,069,595 | 1/1978 | Ahlbert et al. | 34/156 |

*Primary Examiner*—Larry J. Schwartz

*Attorney, Agent, or Firm*—James E. Bryan

[57] ABSTRACT

This invention relates to an improvement in heat-treating equipment for flat, band-like lengths of materials, using a gaseous flowing drying medium, said equipment being composed of a thermally insulated housing with transmission slots at both ends for a length of material, nozzle conduits arranged in sequential spacing above and below the length of material and directed transversely to the direction of motion of said material and being provided with nozzles and communicating with pressure chambers, at least one heat exchanger connected to suction chambers, and at least one circulating fan, the improvement comprising that the upper and lower nozzle conduits include ledge means between the spacings of the nozzles extending transversely to the length of material and forming together a backflow cross-cut means, cover means mounted between the nozzles of a nozzle conduit of the upper nozzle conduits, and the backflow cross-cut means between the ledges of the upper nozzle conduits being covered with stop means, and the backflow cross-cut means between the ledges of the lower nozzle conduits and between the lower nozzles of a lower nozzle conduit being open toward a suction chamber.

12 Claims, 2 Drawing Figures

EQUIPMENT FOR HEAT-TREATING FLAT, BAND-LIKE LENGTHS OF MATERIAL

Figure 1:
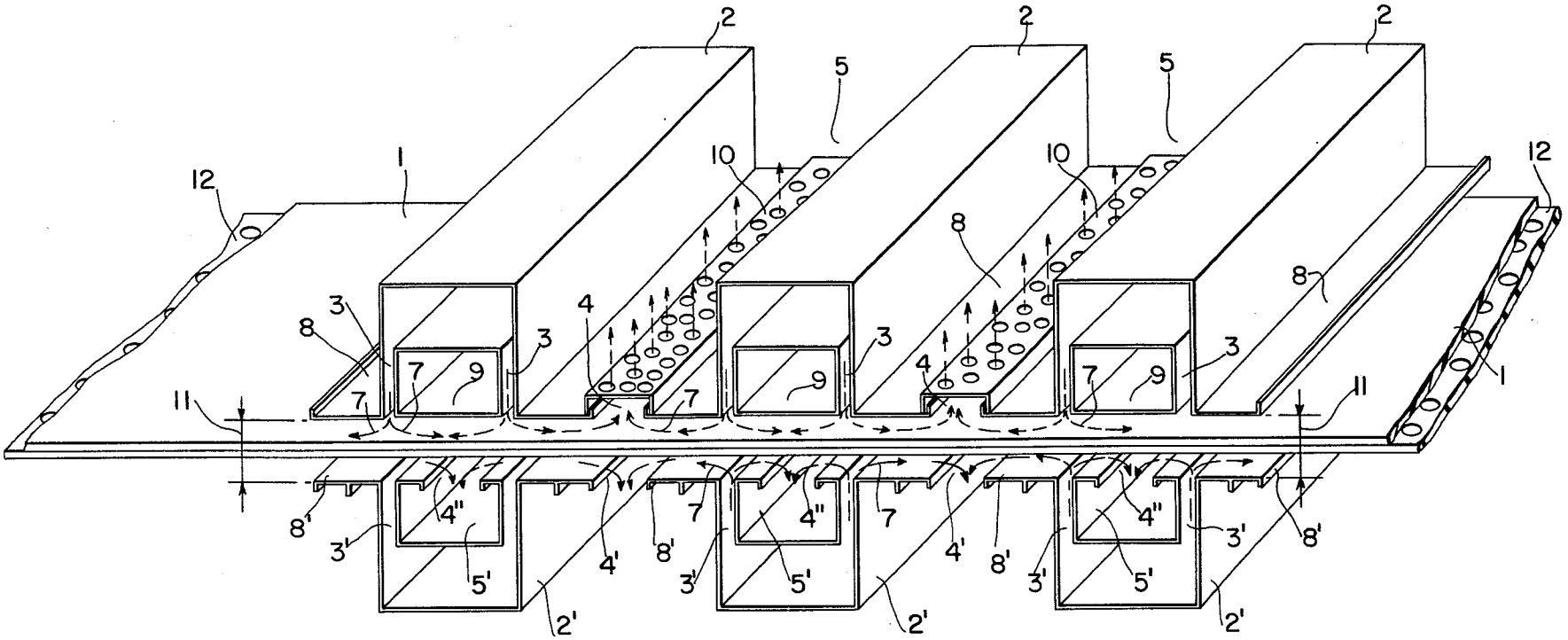

This invention relates to equipment for heat-treating flat, band-like lengths of material, using a gaseous, flowing drying medium, the equipment being composed of a thermally insulated housing with transmission slots at both ends for the material, nozzle conduits including nozzles and being connected to pressurized chambers, the conduits being mounted above and below the length of material being sequentially spaced with respect to one another and mounted transversely to the direction of motion of the web of material, at least one heat exchanger connected with suction chambers, and at least one gas circulating fan.

Known equipment, from German Auslegeschrift No. 10 34 128 and German Auslegeschrift No. 24 43 395, for instance, i.e. so-called convection dryers for heat-treating band-like lengths of materials, for instance, foils, paper or the like, achieve their drying or evaporation performance by blowing against the length of material or from both sides thereon. The drying medium, mostly hot air, flows out of nozzles mounted in nozzle boxes or conduits, mounted above and below the web, against the material to be dried and after a given time of action then is evacuated or aspirated back by circulating fans in suction or backflow chambers respectively. During this backflow process, the drying medium, i.e. the hot air, flows in a more or less turbulent manner over the surface of the length of material, and the flow causes uncontrollable pressure differences between the top and the lower side of the length of material. If very thin webs are involved in the drying or heat treatment, for instance, very thin foils, then these differences in pressure cause wave and flutter motions, the latter being especially adverse at the edges of the web; they are due to detached flow.

If multi-day drying equipment is involved, for instance, these wave and flutter motions are additionally reinforced at the web of material by a lift due to the differences in air densities.

In practice, such undesired and interfering phenomena have been countered by throttling the circulating air flowing against a web using flaps and/or by throttling only the nozzles mounted underneath the web. While wave and flutter motions are much reduced in this way, in every case also the cost is a simultaneous substantial drop in the drying machine's performance.

It is, therefore, the object of the invention to provide equipment wherein wave and flutter motions are practically eliminated despite the presence of turbulences in the convective heat and drying treatment of very thin lengths of material.

The special advantage of the invention is that through the arrangement of stops, especially aperture stops between the spacings of the upper nozzle conduits, a differential back-suction effect is created between the spaces of the upper nozzle conduits, i.e. between the ledges transverse to the web, together forming a backflow cross-cut, and the free backflow cross-cut between the lower nozzle conduits and within the same. Consequently the drying medium flowing out of upper nozzle conduits, i.e. its nozzles and against the web, is forced to flow a distance along the surface of the web corresponding to the length of the parallel ledges until it flows back into the suction chambers through the backflow cross-cuts arranged in the nozzle conduits.

The rate of the medium flowing back by means of the circulating fans into the suction chambers however is decelerated, i.e. throttled, by means of the stops, especially aperture stops mounted above the backflow cross-cuts. As a result there is a higher static pressure at the upper side of the web than at the lower.

In spite of the high exhaust rates from the nozzles corresponding to the design of the circulating fans, the pressure differences above and below the web will cause a differential back-suction of the flowing drying medium. This resulting excess pressure acts in a steadying way on the web and maintains it completely wave-free and flutter-free against the conveyor belt (for instance a sieve cloth) even at high speeds. Therefore, additional throttling of the inflowing lower air, and hence a reduction in the dryer equipment efficiency, no longer is required. On grounds of process engineering, the effect of the differential back-suction can be moved from the upper side to the lower one of the web. This will be applicable, for instance, when the length of material should be lifted off of the conveyor belt, i.e. when it should float. In that case the stops must be integrated into the lower backflow cross-cuts.

Figure 2:
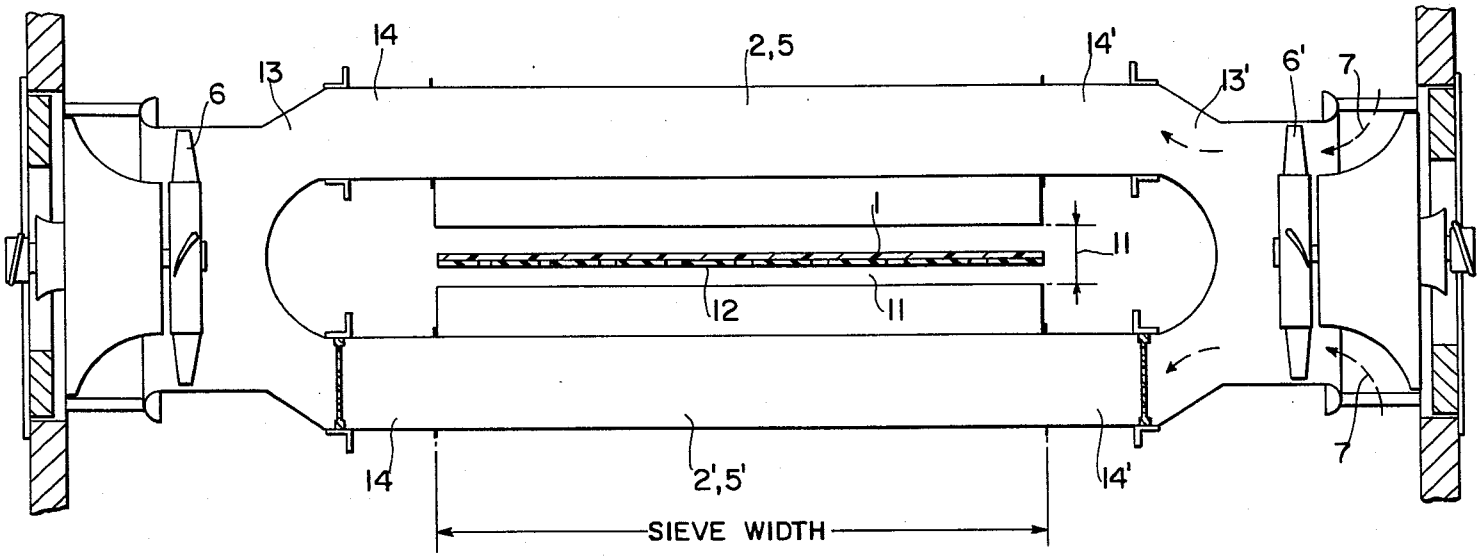

An illustrative embodiment is described below with reference to the accompanying drawings, in which:

FIG. 1 is a perspective view of sequentially spaced nozzle conduits with nozzles, backflow cross-cuts, and suction chambers, and FIG. 2 is a front view of heat-treating equipment for lengths of materials.

FIG. 1 is a perspective and partial side view of sequentially spaced nozzle conduits 2,2' above and below a length of material 1, with the nozzles 3,3', backflow cross-cuts 4,4',4'' and suction chambers 5,5'. The drying medium 7 (see arrows of flow direction) flowing out of the nozzles 3,3' from above and below against the web 1, i.e. being blown by the circulating fans 6,6' (FIG. 2), is evacuated by the fans through the backflow cross-cuts 4,4',4'' which are arranged between the nozzle conduits 2,2' above and below the web 1 and within the lower nozzle conduits 2' and communicate with the suction chambers 5,5'. The drying medium 7 flows out of the nozzles 3,3' first along the ledges 8,8' which are transverse to the web 1 and together form the back-flow cross-cuts 4,4',4'' and along the cover means 9 at the upper nozzle conduits 2, being forced in this manner to flow a distance corresponding to the width of the ledges 8,8' and the cover means 9 along the web 1 and upon reaching the backflow cross-cuts 4,4',4'' will flow back into the suction chambers 5,5'. The upper backflow cross-cuts 4 are covered by easily removable aperture stops 10. As a result, the drying medium 7 flowing back, or aspirated into the backflow cross-cuts 4 is decelerated in its flow, whereby a static excess pressure builds up at the top side of the length of material 1 and along its surface with respect to the lower side. This means that the decelerating effect of the aperture stops 10 results in a differential back-suction of the drying medium 7 into the suction chambers 5. This differential back-suction, i.e. the excess pressure prevailing along the surface of the web 1 forces this web by its lower side in a relatively firm manner and completely free of wave and flutter motions against a sieve cloth and conveyer belt 12 moving between the upper and lower nozzle conduits 2,2' or in a treatment channel 11 (FIG. 2) thus formed.

The drawing's section through the equipment for heat treatment shown in FIG. 2 shows the arrangement of the length of material 1 above or on the sieve cloth and conveyor belt 12, the nozzle conduits 2,2' mounted above and below the length of material and forming the treatment channel 11, the suction chambers 5,5' and the circulating fans 6,6' mounted on both sides. The circulating fans 6,6' communicate with the nozzle conduits 2,2' and suction chambers 5,5' by means of Y pipes 13,13' and junction boxes 14,14'.

It will be obvious to those skilled in the art that many modifications may be made within the scope of the present invention without departing from the spirit thereof, and the invention includes all such modifications.

What I claim is:

1. In heat-treating equipment for flat, band-like lengths of materials supported on a gas-permeable perforated conveyor means, using a gaseous flowing drying medium, said equipment being composed of a thermally insulated housing with transmission slots at both ends for a length of material, nozzle conduits arranged in sequential spacing above and below the length of material and directed transversely to the direction of motion of said material and being provided with nozzles and communicating with pressure chambers, at least one heat exchanger connected to suction chambers above and below the length of material, and at least one circulating fan communicating with said nozzle conduits and suction chambers, the improvement comprising that the upper and lower nozzle conduits include ledge means between the spacings of the nozzles extending transversely to the length of material and forming together a backflow cross-cut means, the backflow cross-cut means between the ledges of the upper nozzle conduits being covered with stop means reducing the open area of said backflow cross-cut means and flow therethrough, and the backflow cross-cut means between the ledges of the lower nozzle conduits and between the lower nozzles of a lower nozzle conduit being open toward a suction chamber, whereby a uniform discharge of drying medium is obtained from the upper and lower nozzle conduits, and a differential evacuation of drying medium in the suction chambers above and below the length of material.

2. Equipment according to claim 1, in which the ledge means of the upper nozzle conduits are longer than the ledge means of the lower nozzle conduits.

3. Equipment according to claim 1, in which the stop means is an aperture stop.

4. Equipment according to claim 1, in which the stop means is exchangeable.

5. Equipment according to claim 1, in which the stop means of the upper backflow cross-cut means can be set on the lower backflow cross-cut means, and vice-versa.

6. Equipment according to claim 5, in which the stop means has different cross-sectional apertures.

7. Equipment according to claim 5, in which the backflow cross-cut means can be covered with aperture stop means of the same or different cross-sectional apertures.

8. Equipment according to claim 1, in which the nozzle conduits include at least two nozzles.

9. Equipment according to claim 1, including means whereby the nozzles can be fed from both sides with the drying medium.

10. Equipment according to claim 1 in which the discharge and evacuation of the drying medium is effected substantially perpendicularly to the length of material.

11. Equipment according to claim 1 in which the upper and lower nozzle conduits are similar in construction, and differential evacuation of drying medium is effected by varying the return flow cross-section in spaces between said upper and lower nozzle conduits.

12. Equipment according to claim 1 in which the cross-section of the flow of evacuated drying medium is formed by the spacing of said ledge means, and including means for restricting said cross-section to obtain desired differences in said flow.

* * * * *